US006699141B1

(12) United States Patent
Florian

(10) Patent No.: US 6,699,141 B1
(45) Date of Patent: Mar. 2, 2004

(54) GOLF PUTTING AND SWING TEACHING AID

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 10/299,545

(22) Filed: Nov. 20, 2002

(51) Int. Cl.[7] ..... A63B 69/36
(52) U.S. Cl. ..... 473/257
(58) Field of Search ..... 473/218, 219, 473/257, 261, 262, 265, 266, 267, 268, 278, 279

(56) References Cited

U.S. PATENT DOCUMENTS

| | | | | | |
|---|---|---|---|---|---|
| 2,992,005 | A | * | 7/1961 | Lockhart | 473/257 |
| 3,073,602 | A | * | 1/1963 | Bell | 473/229 |
| 3,104,108 | A | * | 9/1963 | Robertson | 473/229 |
| 3,332,688 | A | * | 7/1967 | Gevertz | 473/265 |
| 3,471,155 | A | * | 10/1969 | Donaldson | 473/260 |
| 3,860,247 | A | * | 1/1975 | Taylor | 473/218 |
| 3,885,796 | A | * | 5/1975 | King | 473/265 |
| 4,783,075 | A | * | 11/1988 | Simjian | 473/159 |
| 4,805,912 | A | | 2/1989 | Hickman | |
| 4,984,802 | A | * | 1/1991 | Barraclough | 473/229 |
| 5,074,565 | A | * | 12/1991 | Tucker | 473/229 |
| 5,125,844 | A | * | 6/1992 | Grant et al. | 434/252 |
| 5,131,659 | A | * | 7/1992 | Lindberg, Jr. | 473/267 |
| 5,294,124 | A | * | 3/1994 | Florian | 473/267 |
| 5,409,231 | A | * | 4/1995 | Kueng et al. | 473/261 |
| 5,429,368 | A | * | 7/1995 | Adams | 473/162 |
| 5,435,547 | A | * | 7/1995 | Lee | 473/225 |
| 5,458,336 | A | * | 10/1995 | Miller | 473/262 |
| 5,595,543 | A | * | 1/1997 | Wolk | 473/162 |
| 5,630,719 | A | | 5/1997 | Franklin | |
| 5,919,096 | A | * | 7/1999 | Kim | 473/159 |
| 6,019,685 | A | * | 2/2000 | Fonseca et al. | 473/265 |
| 6,129,639 | A | * | 10/2000 | Brock et al. | 473/260 |
| 6,350,207 | B1 | * | 2/2002 | Arcuri | 473/223 |
| 6,540,620 | B1 | * | 4/2003 | Consiglio | 473/150 |

* cited by examiner

*Primary Examiner*—Raleigh W. Chiu
*Assistant Examiner*—Nini F. Legesse
(74) *Attorney, Agent, or Firm*—Charles W. Chandler

(57) ABSTRACT

A golf putting and swing teaching aid assists in developing a golfer's "muscle memory". An elongated mat having a putting surface has a pillow supported for movement along the length of the mat. A putter line is formed on the putting surface. A pair of elastic members support the pillow such that when the a putter strikes the pillow, a line on the pillow is aligned with the putter line on the mat to indicate whether the user has made a proper contact of his club and the pillow. He develops his muscle memory by repeatedly practicing and correcting striking the pillow. The pillow can be removed from the pad and replaced by a practice ball to determine his improvement.

Another embodiment of the invention has a pillow that is impacted by a club other than a putter. The resistance of the pillow helps to develop the golfer's swing.

14 Claims, 6 Drawing Sheets

GOLF PUTTING AND SWING TEACHING AID

BACKGROUND AND SUMMARY OF THE INVENTION

Usually a golfer will view an imaginary putter path line from the ball position to the cup location. He tries to strike the ball along the putter path line, but instead improperly strokes the ball along a path that is oblique to the intended line.

The broad purpose of the present invention is to provide an aid for assisting a golfer in developing his "muscle memory" to correctly strike the ball along a correct putter path. In the preferred embodiment of the invention, the teaching aid includes a resiliently coated rod (pillow) that is placed on a putting pad where a practice ball is usually placed. Rubber-bands support each end of the rod so that it opposes the motion of the club as it strikes the pillow toward an imaginary cup.

The putting pad has a line describing the intended ball path. The pillow has a line intended to be aligned with the line on the putting pad. When the golfer correctly and squarely strikes the pillow, the line on the pillow is aligned with the putter path line. After repeatedly practicing this putting motion, the user then removes the pillow from the pad, and replaces it with a practice ball. He then can determine his improvement in his putting stroke.

In another embodiment of the invention, the user can practice his golf swing with other clubs using a similar technique, that is a resiliently coated rod is placed in the location of the ball, with the axis of the rod at right angles to the intended ball path. The ends of the rod are resiliently connected to the pad by rubber strips so as to be independently movable in the direction of the ball travel. By repeatedly and correctly striking the coated rod, the user can develop his muscle memory for a proper swing.

A pylon is mounted adjacent one end of the pad to assist the golfer in properly initiating and completing his back swing.

In either case, the object of the invention is to provide an apparatus to assist the golfer in striking the resiliently coated rod square to the intended line of flight. The putter then tells the body how to react.

Some prior art related to this invention includes U.S. Pat. No. 4,805,912 issued Feb. 21, 1989 to Robert D. Hickman for "Golf Putting Teaching Aid"; and U.S. Pat. No. 5,630,719 issued May 20, 1997 to Terry W. Franklin for "Golf Putting Teaching Aid".

Still further objects and advantages of the invention will become readily apparent to those skilled in the art to which the invention pertains.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
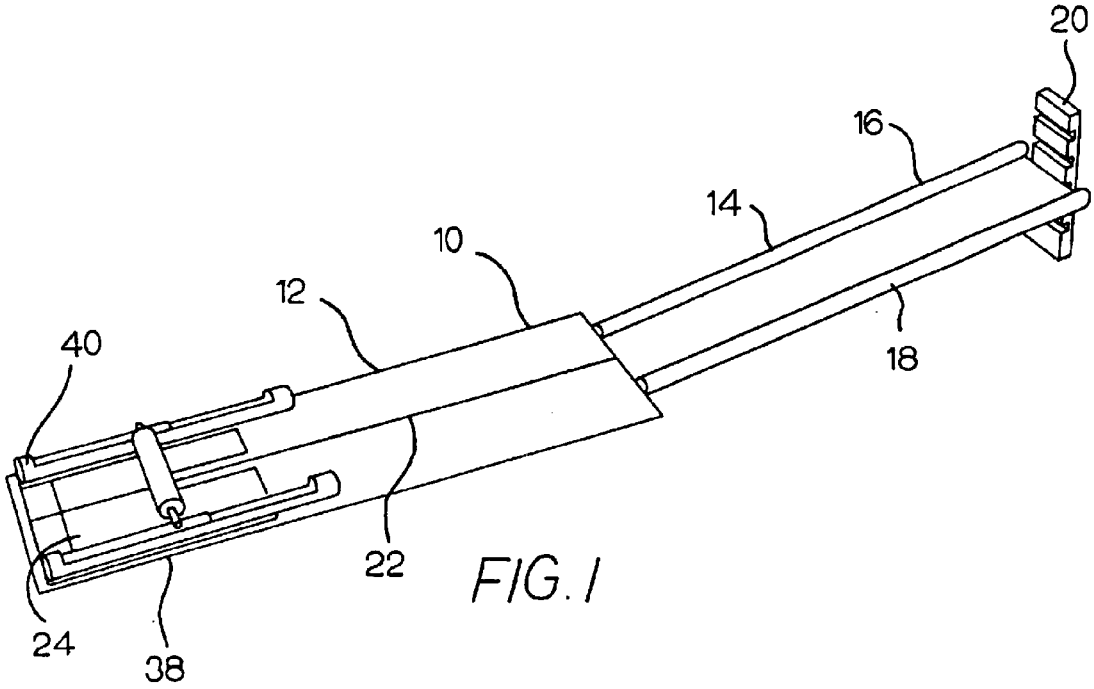
FIG. 1 is a perspective view of a golf putting and swing teaching station illustrating the preferred embodiment of the invention.

Referring to the drawings, FIGS. 1–7 illustrate a preferred practice putting aid 10. Putting aid 10 includes an elongated rectangular putter pad 12, and a pad extension 14. Pad 12 is preferably portable and flexible so that it can be rolled up for storage. It is preferably made of a green artificial turf attached to a foam backing.

Pad 10 is preferably about 37" long and 10" wide. Pad extension 14 has one end mounted in contact with the far end of pad 12, and is also formed of an artificial turf material with a rigid backing, and a pair of bumper rails 16 and 18 along the full length of the sides of the extension pad.

Figure 2:
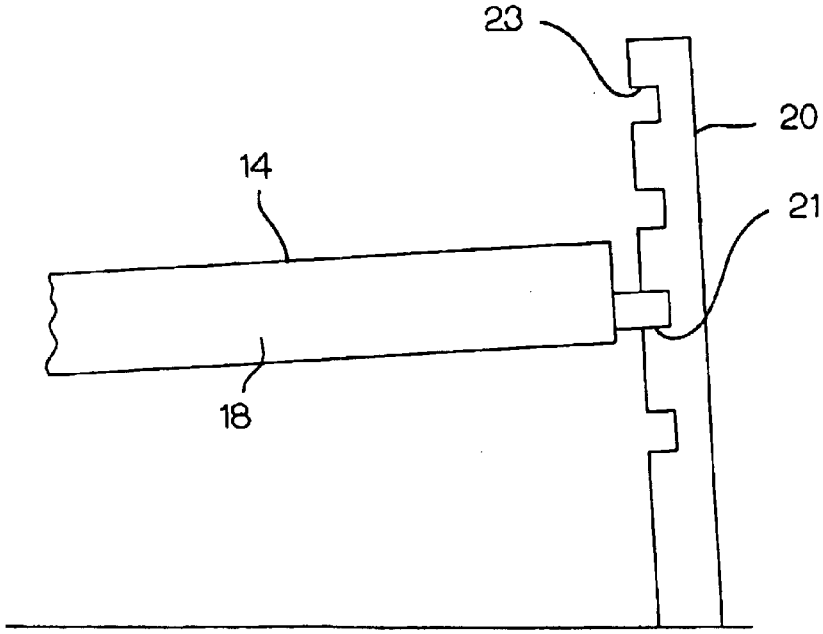
FIG. 2 illustrates a putting pad extension.

Referring to FIG. 2, a notched support 20 is mounted adjacent the end of the pad extension. The pad extension has a lip 21 that is received in a selected one of several notches 23 so that the extreme end of the putting surface can be elevated to a desired height, simulating an uneven ground surface. The putting pad has an elongated putter path line 22 along the center of the pad.

Figure 6:
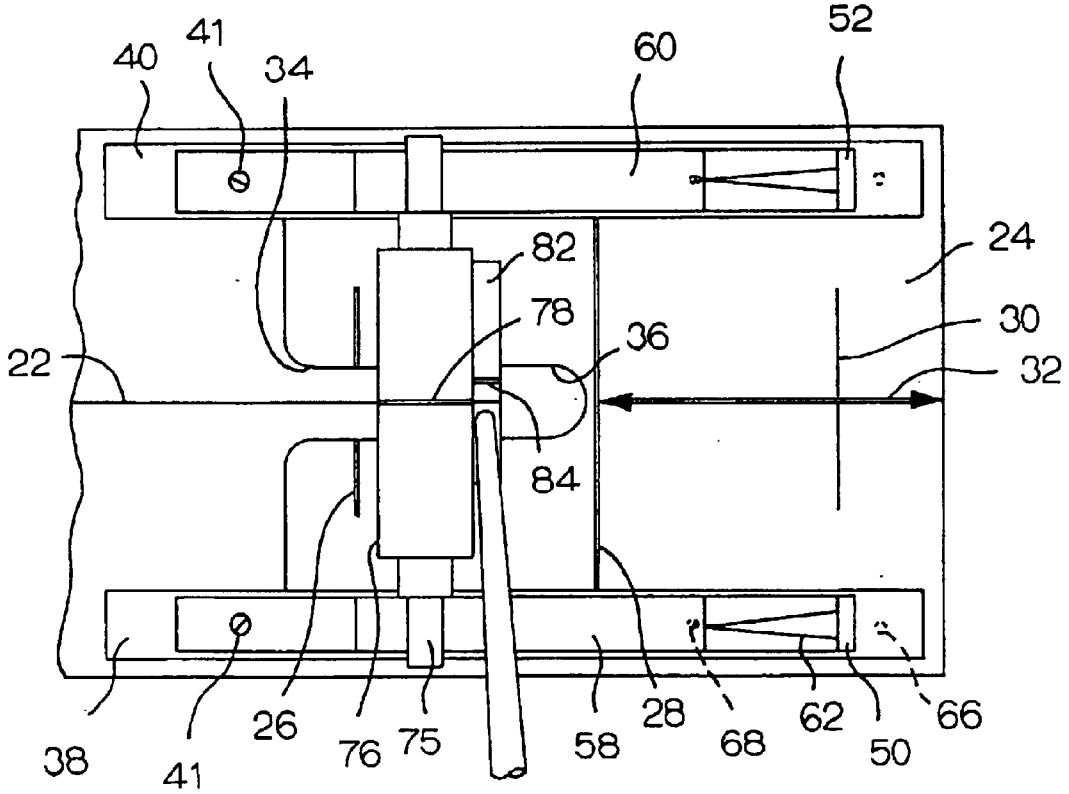
FIG. 6 illustrates the pillow partially driven along the putter path with an improper contact between the club and the pillow.

A mirror 24 is located at one end of the pad. As best shown in FIG. 6, three parallel lines 26, 28, and 30 are inscribed on the mirror. The lines are perpendicular to putter path line 22. Line 28 defines the beginning of a putter stroke. Line 26 defines the end of a practice putter stroke. A fourth line 32 on the mirror is aligned with putter path line 22.

Figure 4:
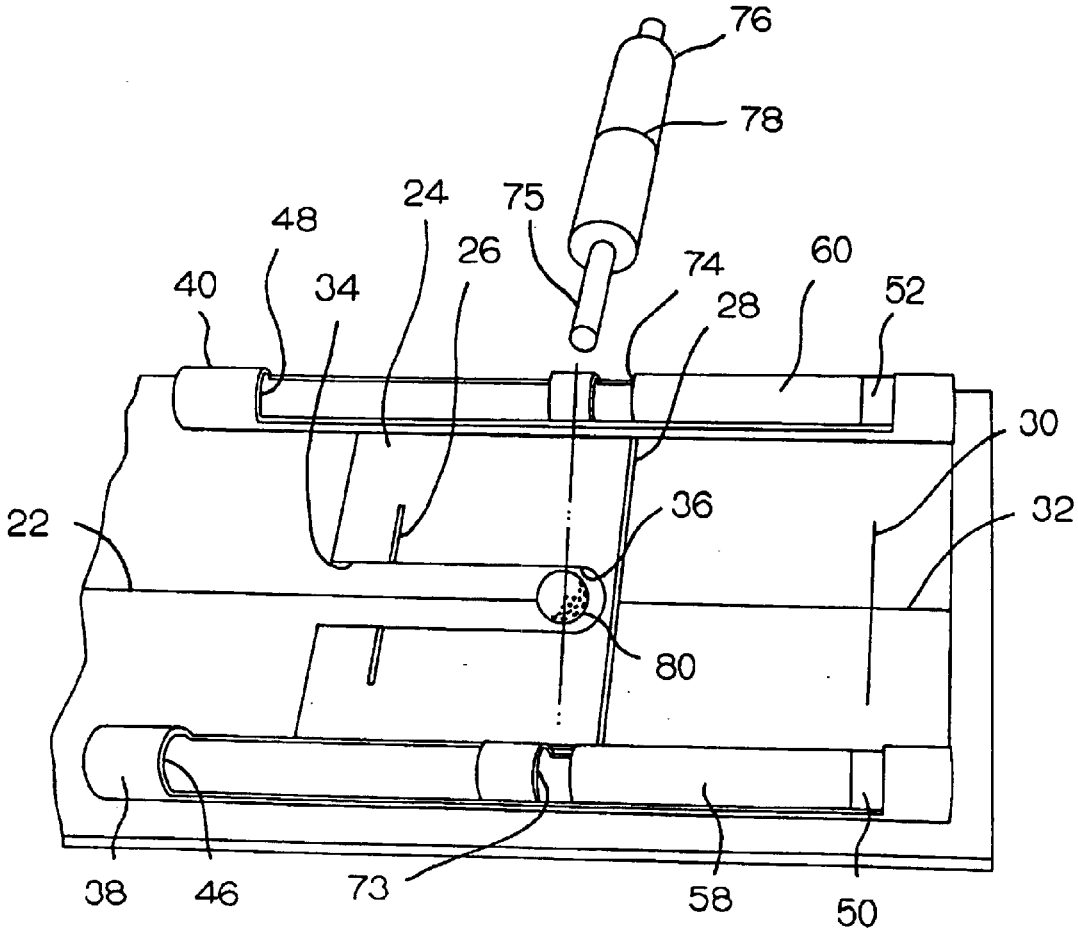
FIG. 4 illustrates the pillow removed from the putting pad.

The mirror has a slot 34 which extends from the left end of the mirror, as viewed in FIG. 4, toward a semi-circular end 36 which is closely adjacent line 28. Preferably the slot is about 5½" long and 1½" wide. The slot exposes a portion of mat 12 permitting the user to mount a practice golf ball directly on the artificial turf. The mirror permits the user to view his head position with respect to the club head as he progresses through a practice stroke.

Referring to FIGS. 3–6, a pair of parallel, horizontal, tubular supports 38 and 40 are mounted adjacent the side edges of mat 12. Threaded fastener means 41 attach the two supports to pad 12. The two supports are identical in configuration and have elongated cut-out openings 42 and 44, respectively, which includes about 180° of the top half of each tube. Opening 42 defines a forward stop 46. Tubular support 40 also has a forward stop 48.

Tubular support 38 also has a short tube 50 extending from the rear end of opening 42. Tubular support 40 has an identical short tube 52 extending forwardly from the rear end of opening 44. The outside diameter of tubes 50 and 52 closely fits the inside diameter of the rear end of tubular supports 38 and 40.

A tubular sliding support 58 is slidably mounted on the lower inside surface of tubular support 38 and has an outside diameter corresponding to the inside diameter of support 38. Sliding support 58 is slidable from a rearmost position in which it abuts tube 50 in a forward direction parallel to putter path line 22.

Similarly, a second tubular sliding support 60 is slidably mounted on the inside lower half of tubular support 40 and is movable from a rearmost position in which it abuts tube 52, toward a forward position in a direction parallel to the putter path line. The two sliding supports are independently movable in their respective tubular supports.

Figure 7:
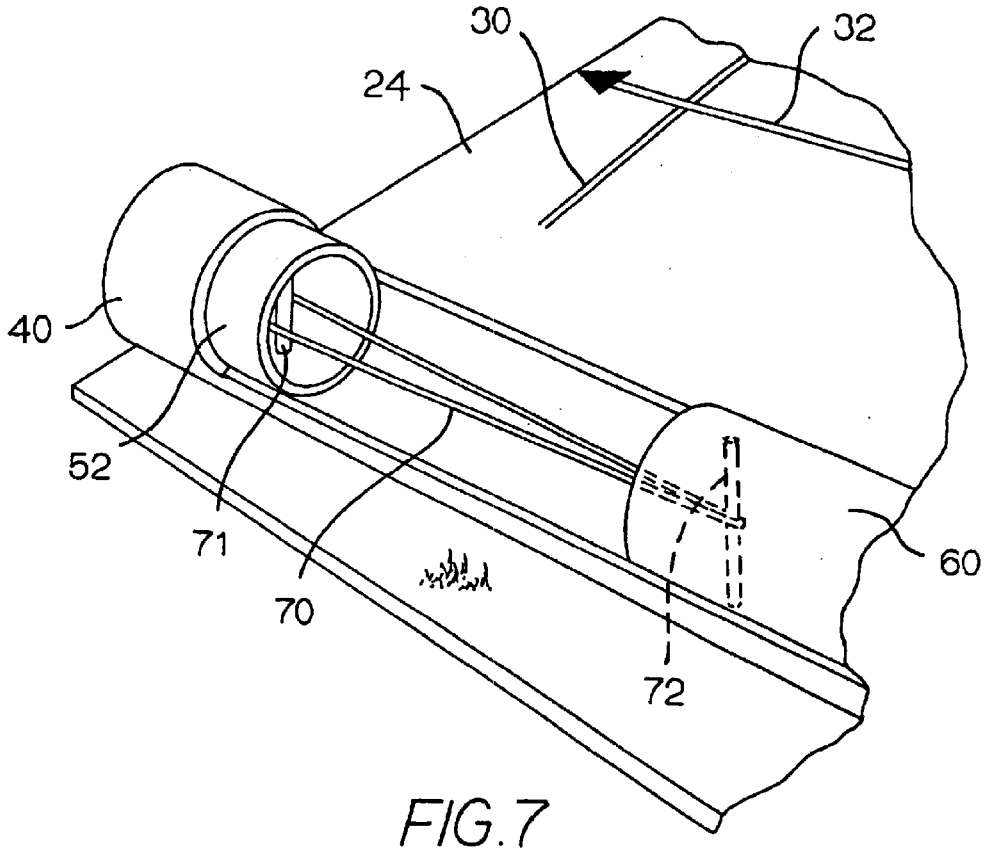
FIG. 7 illustrates a resilient mounting of the one end of the pillow.

Referring to FIGS. 6 and 7, a rubber-band 62 is removably connected between an internal pin 66 in tube 50 and a second internal pin 68 in sliding support 58 to bias it toward tube 50. Similarly, a second rubber-band 70 is removably mounted between an internal pin 71 in tube 52, and a second internal pin 72 in sliding support 60 to bias sliding support 60 toward tube 52. The two rubber-bands are replaceable so that the user can customize the resiliency of the two sliding supports, that is, he can use either stronger or weaker rubber-bands. A spring member could be substituted for each of the rubber-bands.

The two sliding supports have cut-out portions 73 and 74, respectively, for journalling the ends of tubular rod 75. Rod 74 is covered with a relatively thick soft rubber cover 76.

The rigid ends of covered rod 75 (pillow) are independently movable within their respective tubular sliding supports, that is one end of the rod can move forwardly with respect to the other end of the rod.

Figure 3:
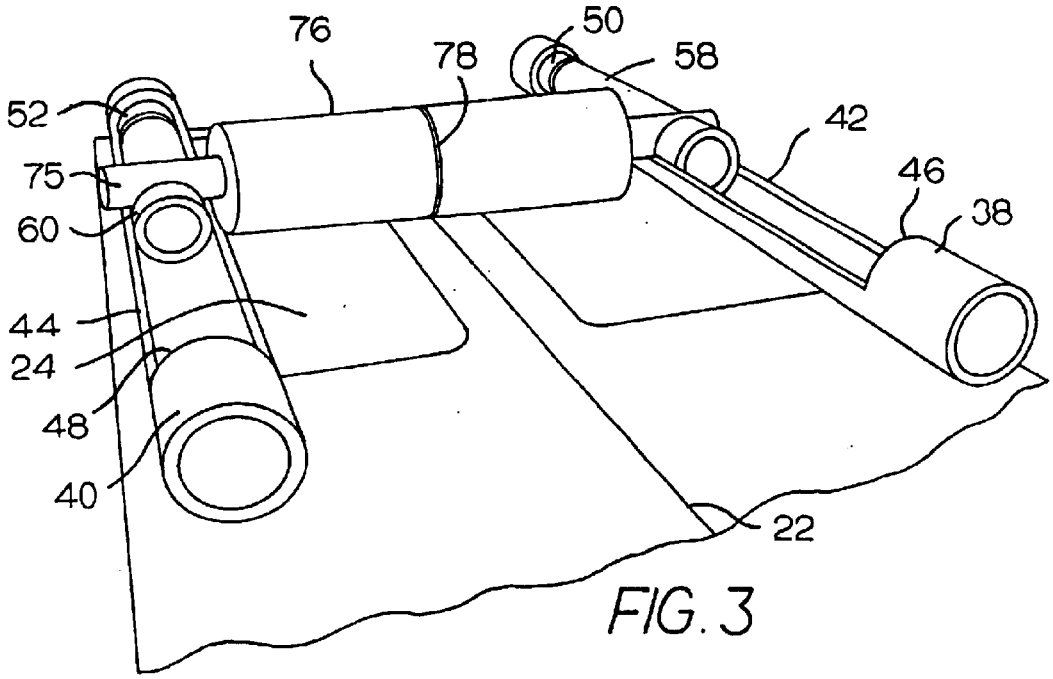
FIG. 3 is a perspective view showing how the ends of the pillow are releasably mounted on the pad.
Figure 5:
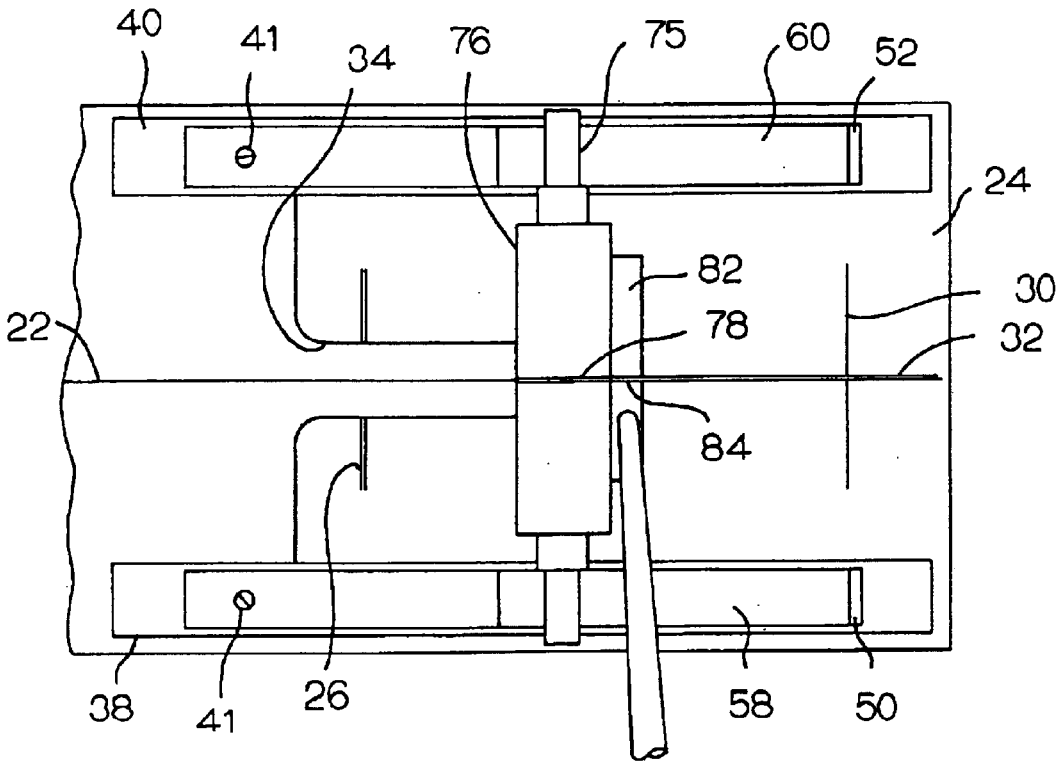
FIG. 5 is a view showing a golf putter contacting the pillow during a putting stroke.

Cover 76 has a line 78 which is alignable with putter path line 22, as best shown in FIGS. 3 and 5. Pillow 75 is removable from cut-out portions 73 and 74, as illustrated in FIG. 4, so that the user can place a practice ball 80 on the putter path line and strike the ball along the line.

Referring to FIG. 5, in use, the head of a putter 82 is placed parallel to rod 75 with line 84 on the putter head aligned with line 78 on the pillow which in turn is aligned with putter path line 22. He then moves the putter head toward the right from the pillow toward line 30, and then using a putting motion strokes the pillow to advance it until the pillow is aligned with line 26.

Using many repetitions, the user's muscles will become accustomed to placing the putter so that it is flat against the pillow and then moving the putter in a correct putting cycle.

FIG. 6 illustrates an incorrect putter stroke. Note that line 78 is not correctly aligned with the putter path line 22.

For longer putts, the user can strike the ball so that it climbs up pad extension 14 until finally striking notched support 20.

FIGS. 8–11 illustrate another embodiment of a golf practice aid in the form of a frame 100 supporting a simulated grass pad 102. Pad 102 is elongated preferably having a width of 11¼" and a length of 50½". A pillow 104 is mounted on the pad. The pillow includes a resilient cover 106 mounted on a rod 108.

Frame 100 has a pair of tubular side members 110 and 112. Rod 108 has a length such that its opposite ends overlap side members 110 and 112.

Figure 10:
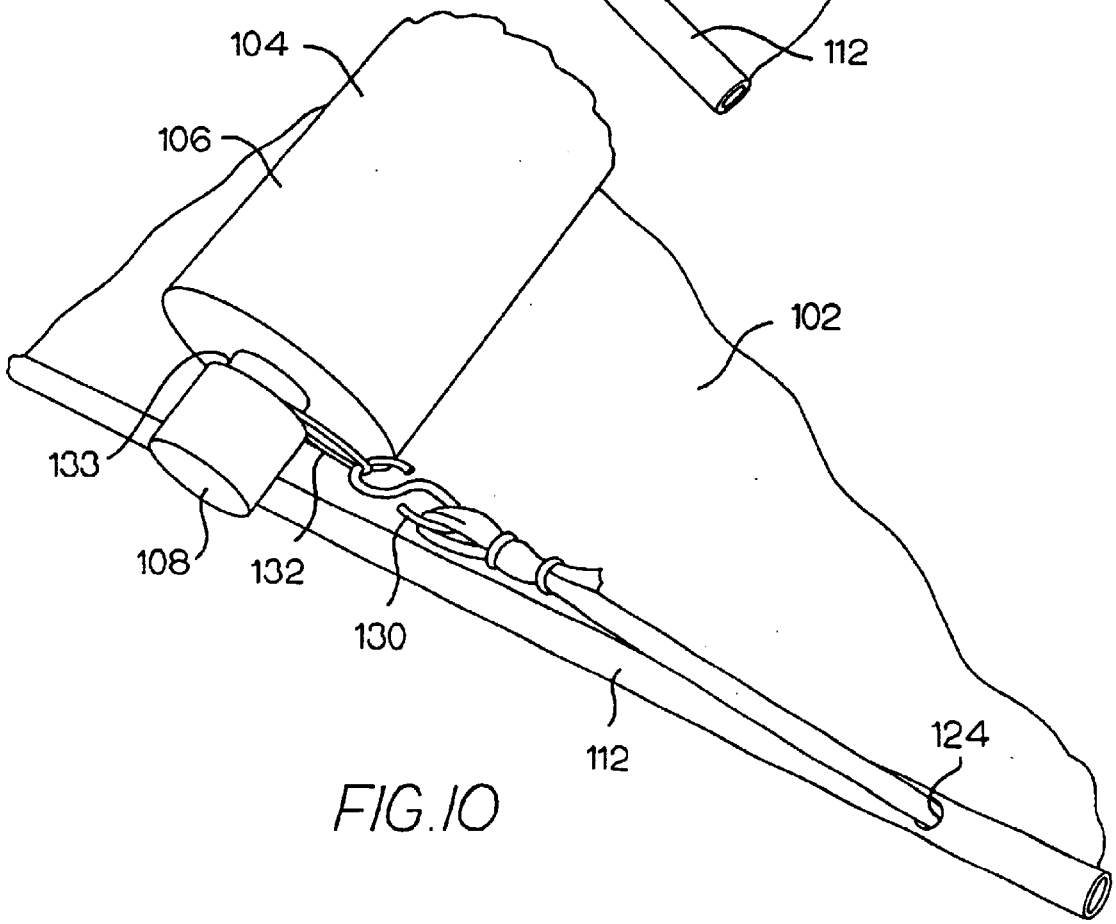
FIG. 10 is a view of one end of the pillow in its extended position.

Referring to FIG. 10, a resilient elongated strap 116 extends through an opening 124 in frame member 112. Similarly, a second resilient elongated strap 126 extends through an opening 128 in frame member 110. The inner end of each strap is connected by a pin, not shown, in the same manner as strap 116. The outer end is connected by a hook 130 and a loop 132 to a groove 133 in the respective end of the rod. Thus, each end of the pillow is independently movable so that the pillow can be skewed with respect to the length of the pad. The straps are replaceable for either stronger or weaker straps to accommodate the strength and the desires of the particular golfer.

The center of cover 106 has a white band 134 to provide a point of impact for the golf club to strike the pillow.

In use, the golfer swings the club to strike the pillow squarely and repeats this process many times. The resistance provided by the resiliently mounted pillow develops the particular muscles necessary to accurately strike a ball squarely with respect to an intended line of flight.

Figure 8:
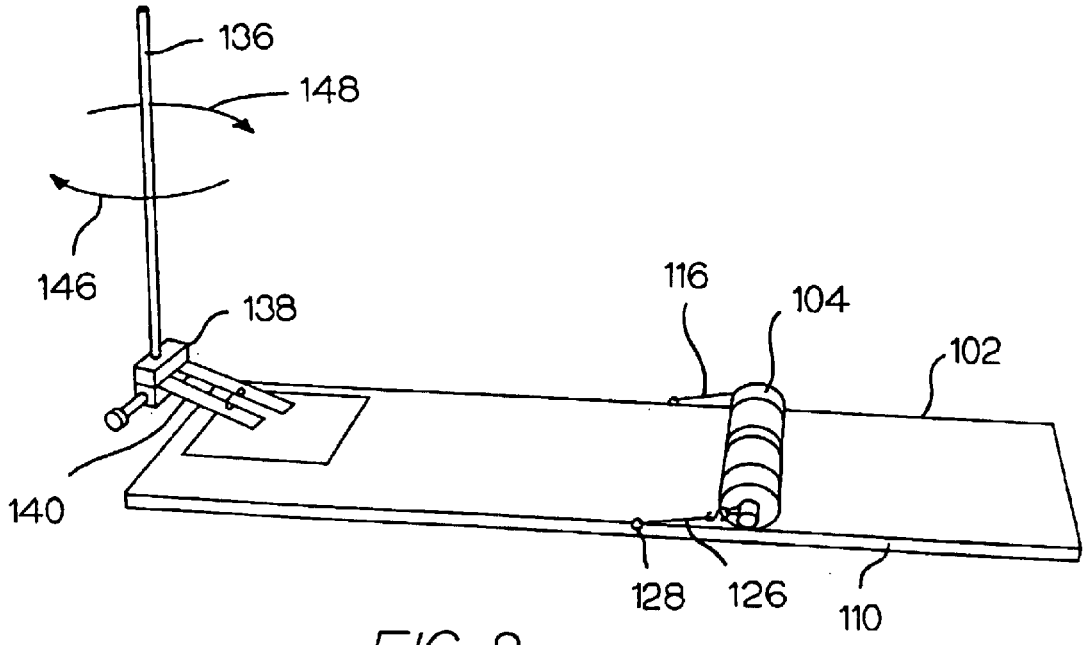
FIG. 8 is a view of another embodiment of the invention for practicing a golf swing.
Figure 9:
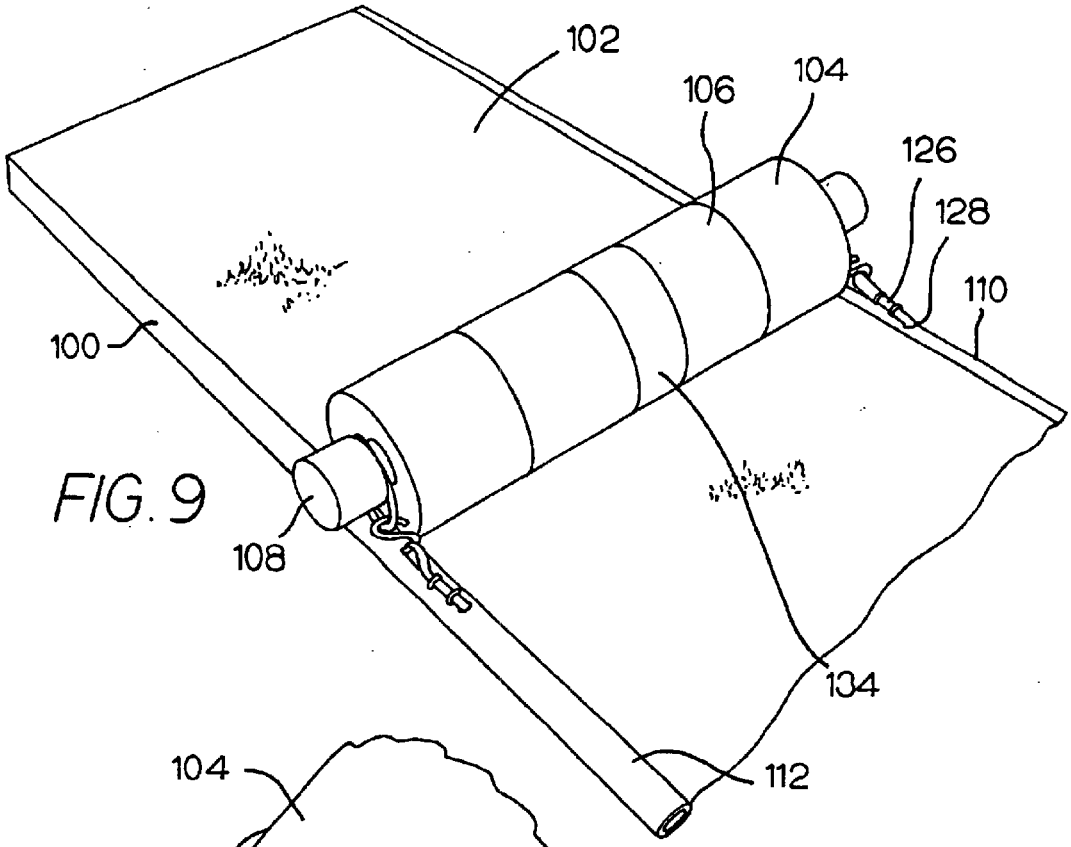
FIG. 9 is a view of the pillow in its fully retracted position.
Figure 11:
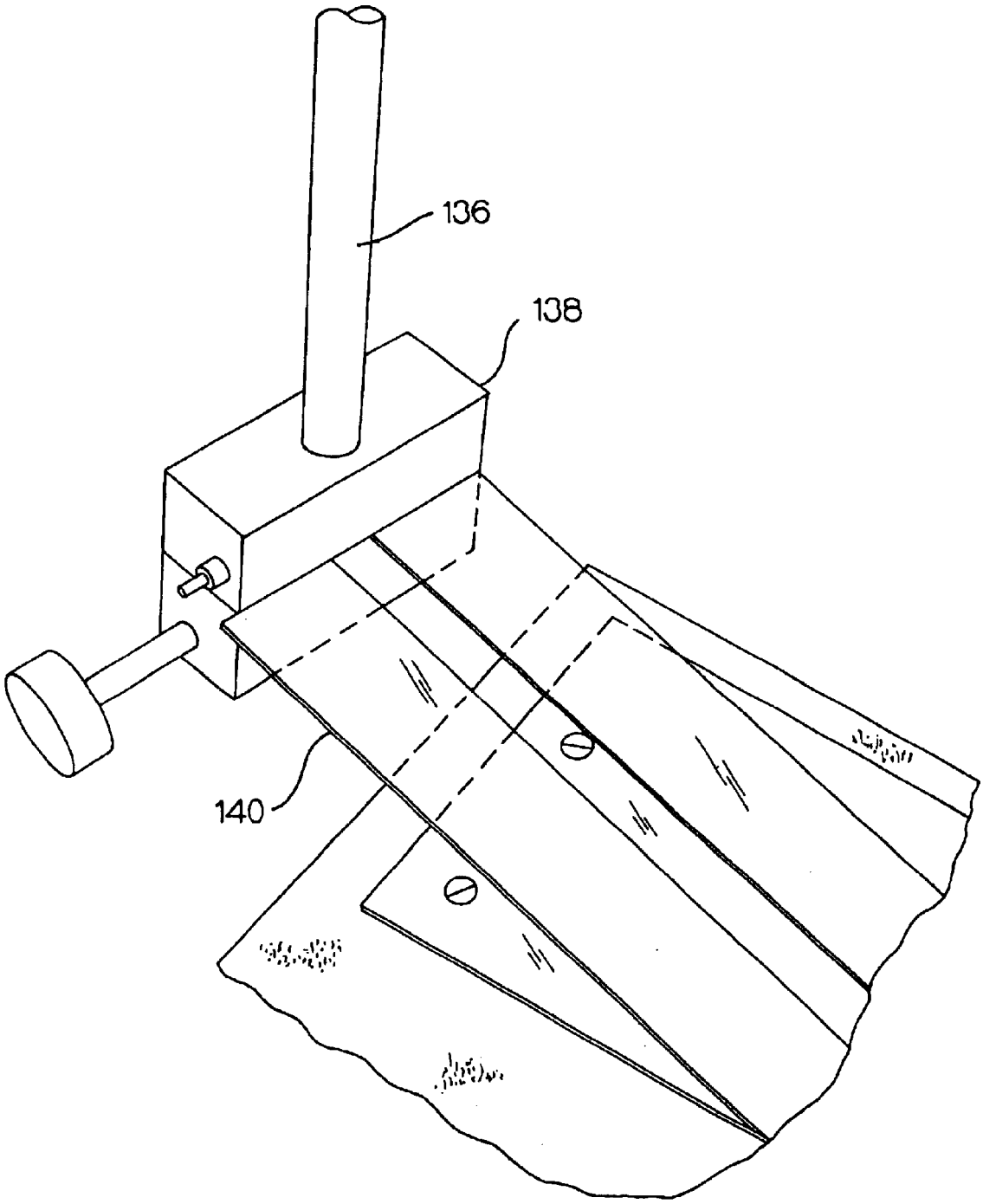
FIG. 11 is a view showing the matter in which a pylon is connected to the practice pad.

Referring to FIGS. 8 and 11, a pylon 136 is mounted in a block 138 along the path of the back swing of the user's club. Block 138 is attached by a plastic connector 140 to the golf mat so that the horizontal location of the pylon can be adjusted with respect to the user's back swing. In practice, the user swings his club in a back swing on one side of the pylon as illustrated by line 146 and then in a forward motion on the opposite side of the pylon in the direction of arrow 148 toward the pillow.

Having described my invention, I claim:

1. A practice golf putting apparatus, comprising:

a base having a planar upper putting surface, the base having a putter path line:

a pillow having a longitudinal axis and a pair of opposite rigid ends, the pillow having a club-striking surface;

means forming a line on the pillow aligned with the putter path line, but movable toward a nonaligned position;

support means mounted on the base for supporting the pillow for motion along said putter path line at right angles to the longitudinal axis of the pillow, and in a plane parallel to the putting surface of the base; and the support means engaging the rigid ends of the pillow such that each end is independently movable in said plane from a first position toward a second position in the direction of the putter path line, at such times as the pillow is struck by a golf club.

2. A practice golf putting apparatus as defined in claim 1, in which the base includes a mat having artificial grass mounted beneath the pillow.

3. A practice golf putting apparatus as defined in claim 1, in which the base is elongated and has an elongated extension of the base having first and second ends, and means for disposing the first end of the extension adjacent the end of the base, and means for adjusting the second end of the extension at a preselected height with respect to the base such that a playing object can be rolled along the putter path line and then up the extension.

4. A practice golf putting apparatus as defined in claim 1, in which the pillow has a resilient layer for receiving the impact of a golf putter.

5. A practice golf putting apparatus as defined in claim 1, in which the pillow is located in a putting position on the base, and the pillow is removable from the base for placing a practice ball in said putting position.

6. A practice golf putting apparatus as defined in claim 1, including a pair of resilient supports spaced along opposite side edges of the base for mounting the rigid ends of the pillow on such supports, and means for resiliently retaining the resilient supports in a first position on the base such that the pillow is movable toward a second position as the pillow is impacted by a putter head.

7. A practice golf putting apparatus as defined in claim 1:

in which the base is elongated and has a first end, a second end and a pair of spaced parallel side edges extending from the first end to the second end;

a pair of spaced parallel tubular supports disposed adjacent said side edges on opposite sides of the putter path line and parallel thereto, and means for connecting the tubular supports to the base;

a pair of pillow supports slidably mounted on the tubular supports along the length thereof, and means on the pillow supports for engaging the rigid ends of the pillow such that each end is independently movable along its respective tubular support; and means connected to the pillow supports for biasing the pillow supports in a first direction along the putter path line, such that the user can strike the pillow in the opposite direction along the putter path line.

8. A practice golf apparatus as defined in claim 7, in which the pillow comprises a rigid rod, and a resilient layer disposed about the rod.

9. A practice golf apparatus as defined in claim 1, including a mirror disposed beneath the pillow for the user to view his position as a putter strikes the pillow.

10. A practice golf putting apparatus, comprising:

a practice golf club;

an elongated base having a planar upper putting surface and a longitudinal axis;

a pillow having a longitudinal axis and a pair of opposite rigid ends, the pillow having a club-striking surface;

support means mounted on the base for removably supporting the pillow for motion along the longitudinal axis of the base, and in a plane parallel to the putting surface of the base; and the support means engaging the rigid ends of the pillow such that each end is independently movable in said plane from a first position toward a second position along said longitudinal axis, at such times as the pillow is struck by said golf club.

11. A practice golf apparatus as defined in claim 10, including an upright pylon mounted on the base for defining a back swing of said practice golf club.

12. A practice golf apparatus as defined in claim 10, in which a mirror is disposed beneath the pillow such that a user can view his body during the course of a practice golf club swing.

13. A practice golf apparatus as defined in claim 10, in which the pillow is located in a putting position on the base, the pillow being removable from the base for placing a practice ball in said putting position.

14. A practice golf putting apparatus, comprising:

a practice golf club;

an elongated base having a planar upper putting surface and a longitudinal axis;

a pillow having a longitudinal axis and a pair of opposite rigid ends, the pillow having a club-striking surface;

support means mounted on the base for removably supporting the pillow for motion along the longitudinal axis of the base, and in a plane parallel to the putting surface of the base;

the support means engaging the rigid ends of the pillow such that each end is independently movable in said plane from a first position toward a second position along said longitudinal axis, at such times as the pillow is struck by said golf club; and a pair of resilient supports spaced along opposite side edges of the base, means for mounting the rigid ends of the pillow on such supports, and means for resiliently retaining the resilient supports in a first position on the base such that the rod is movable toward a second position as the pillow is impacted by a golf club head.

* * * * *